US007721454B2

(12) United States Patent
Santangelo et al.

(10) Patent No.: US 7,721,454 B2
(45) Date of Patent: May 25, 2010

(54) ROCK FASHIONABLE CALENDAR HOROLOGE

(76) Inventors: Matthew Santangelo, 2175 Ward Rd., Pennsburg, PA (US) 18073; Peter Detterline, Kutztown University, 588 Levengood Rd., Douglasville, PA (US) 19518

( * ) Notice: Subject to any disclaimer, the term of this patent is extended or adjusted under 35 U.S.C. 154(b) by 0 days.

(21) Appl. No.: 12/641,932

(22) Filed: Dec. 18, 2009

(65) Prior Publication Data

US 2010/0095538 A1 Apr. 22, 2010

(51) Int. Cl.
*G04B 49/00* (2006.01)
*G04B 49/02* (2006.01)

(52) U.S. Cl. ..... 33/270; 33/268

(58) Field of Classification Search ..... 33/268–271, 33/1 SB, 1 SC, 1 DD; 368/15, 16; 968/415
See application file for complete search history.

(56) References Cited

U.S. PATENT DOCUMENTS

| | | | | | |
|---|---|---|---|---|---|
| 6,506 | A | * | 6/1849 | Scott | 33/270 |
| 89,585 | A | * | 5/1869 | Johnson | 33/270 |
| 770,580 | A | * | 9/1904 | Hewitt | 33/270 |
| 1,651,621 | A | * | 12/1927 | O'Sullivan | 33/270 |
| 4,034,549 | A | | 7/1977 | Danley et al. | |
| 4,081,911 | A | | 4/1978 | Eldridge | |
| 4,102,054 | A | | 7/1978 | Lewis | |
| 4,103,429 | A | | 8/1978 | Wagoner | |
| 4,656,748 | A | | 4/1987 | Thual | |
| 4,845,853 | A | | 7/1989 | Haskett | |
| 5,062,212 | A | | 11/1991 | Blaker | |
| 5,181,324 | A | | 1/1993 | Hein | |
| 5,197,199 | A | * | 3/1993 | Shrader | 33/270 |
| 6,009,628 | A | | 1/2000 | Mizushima | |
| 6,308,427 | B1 | | 10/2001 | Kaufmann | |
| 6,367,158 | B1 | | 4/2002 | Keatch | |
| 6,449,854 | B1 | * | 9/2002 | Cheung | 33/268 |
| 6,871,407 | B1 | | 3/2005 | Maegli | |

OTHER PUBLICATIONS

Nebra Sky Disk, Wikipedia online free encyclopedia, May 4, 2009.

* cited by examiner

*Primary Examiner*—Amy Cohen Johnson
(74) *Attorney, Agent, or Firm*—Santangelo Law Offices

(57) ABSTRACT

A calendar indicating device can include easy placement through a north-south block (1) to orient an equinox line (3) to provide sunrise shadow indications of one or more solstice events such as the summer solstice or the winter solstice at the moment of sunrise. Designs can be based on remnants of artifacts that included some of the possible components, even for prehistoric man, in one integral stone device built from a stone base (2). Embodiments may include sunset indicator(s), solar altitude indicator(s), indicators for the maximum solar altitudes on the summer and/or winter solstice dates, and alignment aid(s).

20 Claims, 13 Drawing Sheets

ROCK FASHIONABLE CALENDAR HOROLOGE

TECHNICAL FIELD

Generally this invention and discovery relates to devices that can be used to tell time from a celestial position or event. Specifically, the invention and discovery relates to devices used to tell date or serve as a calendar with no internal time keeping element. It has particular relevance to basic devices such as might have been considered by early man in understanding, calendar events such as the change of seasons and the like.

BACKGROUND

Modern man takes the concept of time for granted. We look at our watch to see the time of day. We look at a calendar to see the time of year or the date. Each of these concepts is indicated and monitored by devices or listings that indicate the passage of time with a high level of accuracy. We know that time is rooted in the movement of celestial bodies. The rotation of the earth defines the time of day; the revolution around the sun defines the time of year. From some perspectives, these constitute the essence of time. These movements create day and night and create summer and winter.

To modern man, the time of day is usually one of the most important time concepts. Regardless what calendar month it is, most persons can stay warm and can buy groceries. Our immediate activities are usually governed at the relatively micro level, the time of day. However, to early man, the time of day or the micro level of time was far less important than a macro level of time, namely, the time of year. Planning for the very activities necessary for survival such as planning for food and planning for warmth did not depend on meeting an appointment or the time of day. Planting and other activities needing to be anticipated or carried out depended far more on the macro level of time, the time of year than on micro level of time, the time of day.

While almost no one in modern society operates without some sort of timepiece, perhaps a watch, cell phone, or PDA, early man could only rely on the position of celestial bodies such as the sun and the stars. As a result, horological devices developed. Frequently, these were sundials or similar types of items. In fact, early sundials trace their roots back to approximately 5000 BCE. The relationship between keeping time and celestial events grew from this and even included the positions of stars and the like in early times. For instance, an artifact known as the Nebra sky disk indicated some level of astrological knowledge as early as approximately 1600 BCE. Astrolabes, and other devices that could indicate some types of time, existed by about 200 BCE. As these types of devices indicated early man realized a relationship between celestial events and at least time of day events.

Certainly there are obvious differences between night and day that made micro levels of time immediately evident. The position of this sun gave early opportunities to permit shadow indications to be used to display a time of day. Devices that utilized shadow indications have existed for years and improvement have continued even into modern times. For instance, U.S. Pat. No. 6,367,158 and U.S. Pat. No. 4,845,853 use shadow indications to show times of day. This is perhaps more common for traditional sundials. U.S. Pat. No. 6,871,407 and U.S. Pat. No. 5,062,212 involve both time and date indications by shadow positioning. They do not, however, provide indication in the manner of the present invention or accomplish the transient type of sun rise indications desired for embodiments of the present invention. Even the calendar date shadow indications on U.S. Pat. No. 4,102,054 are accomplished in a more traditional way, namely, by using shadow indications on an analema which is unlike the present invention.

To grasp the context of the present invention, the importance of a calendar understanding to prehistoric man needs to be understood. If any one person had the ability to understand if seasons were about to change in one direction or another, or if it was an appropriate time to plant certain crops, they may have possessed a status of reverence and awe to those that did not understand what we take now take for granted. In fact, from some perspectives may be likely that calendar time was far more important than a time of day for the latter has an obvious rough indication often available, namely, the position of the sun at that particular time of day. Indeed, it would have been a significant benefit to be able to track calendar time even in a rough degree before the knowledge of a calendar or the like. In fact, it may have appeared that individuals who had an understanding of calendar time, may have held a shaman-like stature within that early society. It is even likely that those individuals who developed an understanding of the relationships between celestial bodies, and calendar timing as it may relate to the change of seasons might have maintained their understanding as proprietary in some manner, and maybe even have utilized it as what we now regard as a trade secret to provide them more significant stature within that society or to foster a shaman presence.

The present invention shows several types of horological devices. These devices could have been developed even by early man to monitor and understand calendar time on a macroscopic scale. One could even consider the present devices as more of a discovery than an invention, for they could be considered as a revelation of knowledge held secret for many years and even millennia. The discoveries presented in this technical disclosure and explanation have been gleaned and discovered from interpreting stone artifacts uncovered that had long concealed the secrets manifested. By reverse engineering these furtive concepts, the present inventors show how revered shamans might have held and developed their understandings. In keeping with the goal of protecting inventions and discoveries, the present technical explanation discloses concepts that might have been maintained undiscovered from perhaps the estimated time of the catalyst artifacts, namely, about 1500 BCE. Through developing how such artifacts might have served even a select contingent of early man, the inventors have developed understandings by which even early man might have been able to monitor calendar time in relation to the movement of celestial bodies. Surprisingly, the present invention shows how devices could easily have been configured to mislead or could have been configured so as to not reveal their true purpose and might intentionally have been designed to conceal the use of a transient occurrence or other indication to achieve an intended purpose. To the uninitiated, the devices can present themselves as some sort of cutting, opening, or splitting device while otherwise being available and used for a true, perhaps concealed, horological purpose.

SUMMARY OF THE INVENTION

The present invention describes various embodiments of inventions that can be used to indicate specific events in calendar time by the movement of celestial bodies. Specifically, the invention provides devices that can be used to indicate any of the solstices as well as the equinox and could be used to precisely identify both winter and summer solstice events. Significantly, the invention lays bare ways to use, integral shaped devices such as might be presented in an artifact in order to indicate each of these calendar events.

Accordingly, the present invention provides a system for telling calendar time without an internal time generator and only by reference to the movement of celestial bodies. Embodiments of the invention may include solstice identification by transient events or only at a specific time. In keeping with the desire to present devices that are especially easy to use and place, embodiments are presented that could have been available to early, prehistoric man. Embodiments may also be designed to be manufactured as an integral device and may even be fashioned from a single rock element. Further, the goal of providing devices that can be easily placed is met by including embodiments that have no particularly precise alignment requirements. Additional embodiments may include multiple solstice indicators as well as solar altitude indications at a particular point in time.

A significant object of the invention is to provide devices that can indicate calendar time at least at particular identified times throughout the calendar year.

In keeping with this object, it is a goal of some embodiments of the invention to permit identification of at least one solstice occurrence at the moment of sunrise.

In further keeping with this object, it is a goal of embodiments of the invention to permit tracking as the calendar passes from equinox to solstice and back again, so that the particular event, perhaps a solstice or even an equinox, can be anticipated and observed.

It is also an object of the invention to provide embodiments that may permit identification and anticipation of one or more maximum solar altitudes through the year.

In further keeping with this object, it is a goal of embodiments of the invention to indicate the maximum solar altitude for both the summer solstice and the winter solstice for a given latitude.

In further keeping with this object, it may be a goal of the invention to facilitate the use of shadow lengths created by a fixed structure.

Naturally, further objects and goals of the invention will become apparent from the description and drawings below.

DESCRIPTION OF THE PREFERRED EMBODIMENTS

As mentioned earlier, the present invention includes a variety of aspects, which may be combined in different ways. The following descriptions are provided to list elements and describe some of the embodiments of the present invention. These elements are listed with initial embodiments, however it should be understood that they may be combined and even varied in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

The invention provides both embodiments of devices and methods through which to monitor calendar time. The devices provide a macroscopic understanding of time, namely, one that mainly indicates a calendar date rather than an individual time of day. Devices shown provide this indication through coordination with celestial events. One aspect of the invention is that it can be accomplished by or manifested in devices that can be a single, integral item such as many withstand the wear of millennia. In some embodiments, the invention presents devices that are integral single rock structures that can provide the desired indications for many years. As shown in the preferred embodiment, these rocks structures can provide a horological element that can serve as a celestial calendar device and present celestial calendar horologes. These horologes can be configured so as to provide shadow indicia on the horological element itself.

As mentioned, the devices can be designed to provide their desired indications at precise points of time during the day. These times may be at sunrise or at sunset or both. One accurate configuration of the device is as a device that provides precisely predictable sunrise indications of the desired calendar events. In keeping with the goal of providing devices that are especially to use and place, embodiments include devices that can be configured in a manner that is extremely non-complex such as might have been used by early man. They also can provide devices that need only rudimentary alignment in order to provide accurate indications. This can be important because they can be and could have been used in environments where understandings may not have existed at a sophisticated enough level to allow precise alignment such as many sundials require.

Figure 1:
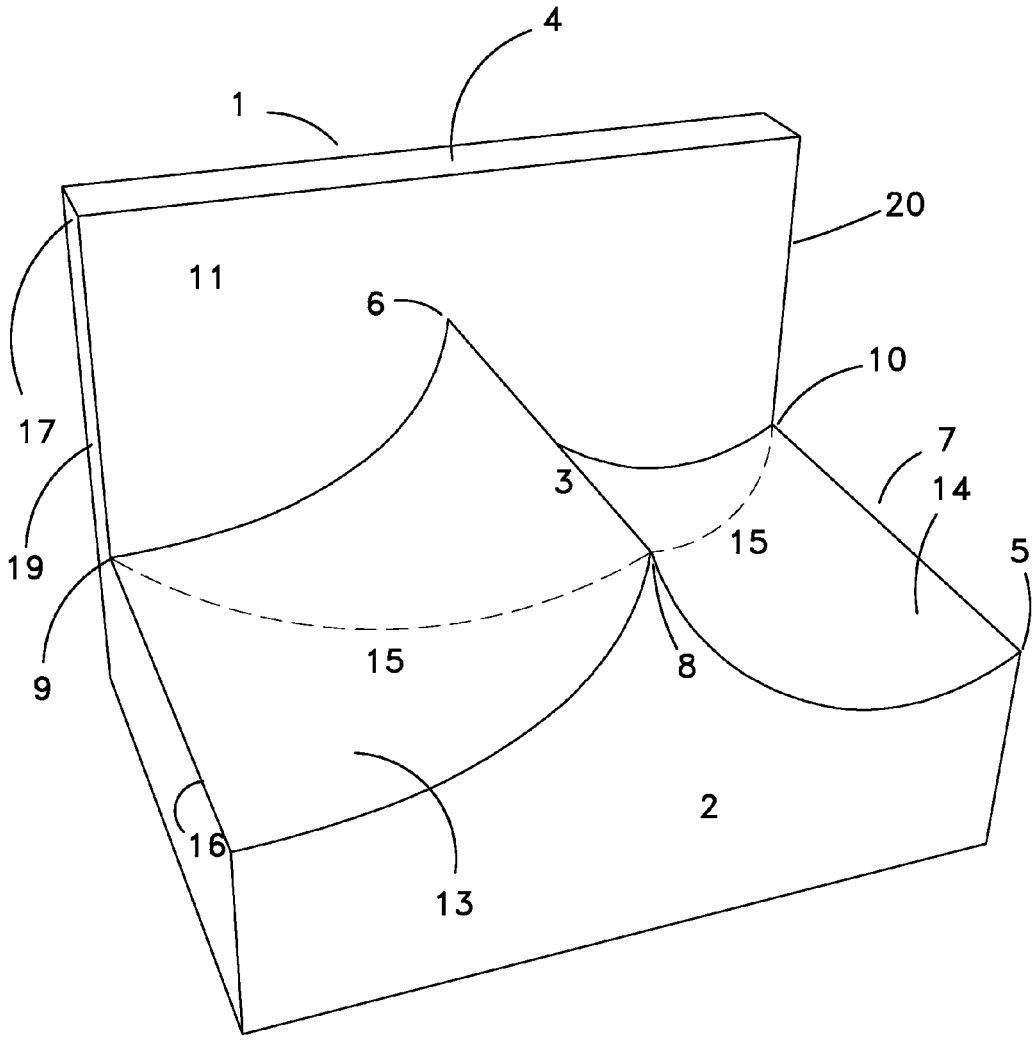
FIG. 1 shows a perspective view of a basic device according to the present invention.
Figure 2:
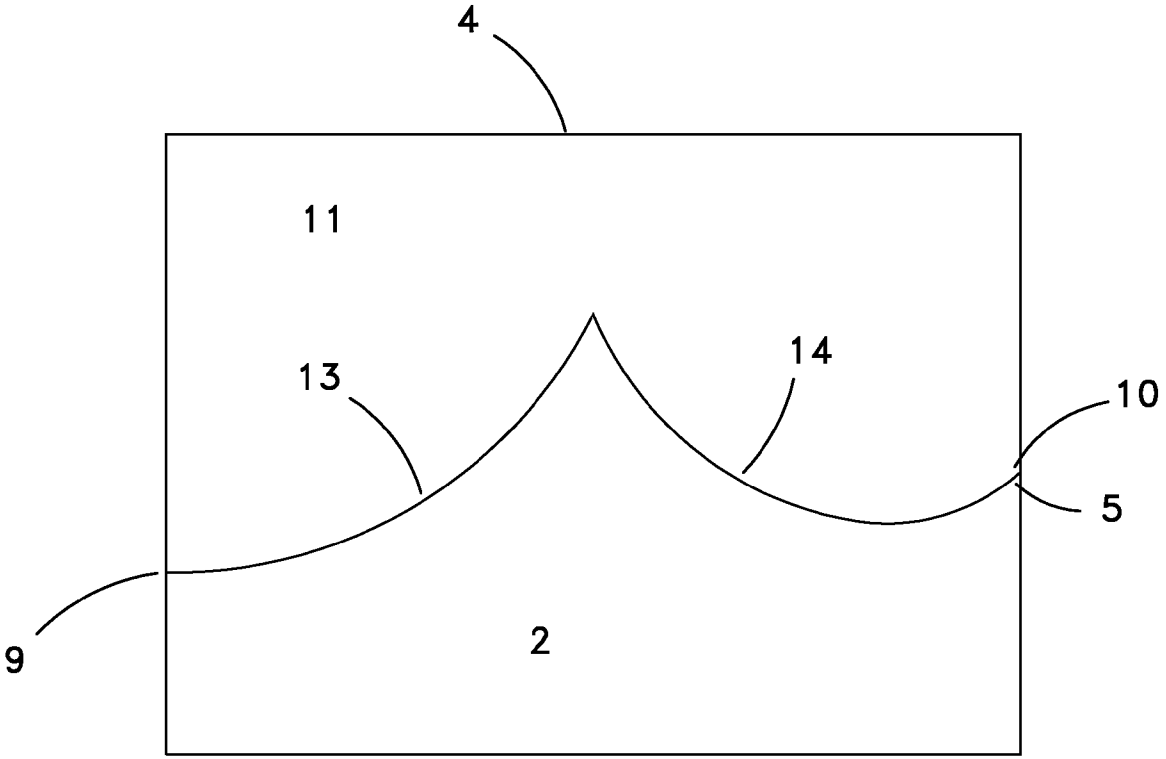
FIG. 2 shows a side view of the basic device depicted in FIG. 1.

In order to fully comprehend the various embodiments of the invention envisioned, it is helpful understand the basic components and terminology of an initial embodiment. FIGS. 1 and 2 show an initial embodiment that includes many of the basic elements. As shown, one integral device can present a stone or other base (2) as a foundation to a stone element that can serve as the horological device. The base (2) can include an operative surface as well as an alignment block. As shown in FIGS. 1 and 2, a component of the stone element can serve as an aligner to permit proper alignment with a limited amount of or no technical understanding. As shown in FIGS.

1 and 2, a stone base (2) can be integral to a north-south block (1). This north-south block (1) can include a raised north-south alignment plane (11). The alignment plane (11) can serve as a solstice indicating portion and can be in contact with and used in conjunction with other elements of the horological device.

An important component for some embodiments can be to allow shadow indications. As shown, the stone base (2) can form shadow surfaces upon which a shadow falls adjacent to the north-south block (1). On or near a shadow surface, there may be an equinox line (3), which may have an equinox line end (8) and an equinox line terminus (6). The equinox line terminus (6) can abut the north-south block (1). For ease of understanding the shadow indications, in some embodiments, the equinox line (3) may project more or less orthogonally from the north-south block (1). As shown in FIGS. 1 and 2, the equinox line (3) may present itself on or as a raised precipice that may extend from the equinox line end (8) to an opposite end such as an equinox line terminus (6). This equinox line (3) can split a north shadow surface (14) and a south shadow surface (13).

The north shadow surface (14) can have a winter solstice sunrise corner point (10). This winter solstice sunrise corner point (10) can be formed from the stone or other base (2). In use, the sun may cast a shadow that may terminate on the device along a shadow edge line (15). As explained later in more detail, at a particular time of year, in this instance, most notably the winter solstice, at sunrise, this is shadow edge line (15) may project on a north shadow surface (14) from the equinox line end (8) to the winter solstice sunrise corner point (10). As may be appreciated from the figures, the north shadow surface (14) may abut a bottom of the raised north-south alignment plane (11). It may also terminate in a raised lip (5). This raised lip (5) on a north shadow surface (14) may be opposite and parallel to the equinox line (3).

In similar fashion, the stone or other base (2) can support a south shadow surface (13). This south shadow surface (13) can form or be adjacent a summer solstice sunrise corner point (9) such as at one corner. The summer solstice sunrise corner point (9) can be formed from the stone base and can be a corner of the south shadow surface (13). Again, as with the north shadow surface (14), the south shadow surface (13) can be formed from the stone base adjacent to the south side of the equinox line (3) and also can abut the raised north-south alignment plane (11). The south shadow surface (13) can be configured in order allow or facilitate presentation of a shadow edge line (15) on it. The shadow edge line (15) can projects on a south shadow surface (13) at a particular time of year, especially on the summer solstice. As explained later in more detail, and as with the north shadow surface (14), the south shadow surface (13) can form a shadow at sunrise from the equinox line end (8) to the summer solstice sunrise corner point (9) that can indicate the occurrence of the summer solstice.

As mentioned earlier, it is a goal of the invention to provide devices that are especially easy to use and place, and to present embodiments that could have been available to early, prehistoric man. In order to use this type of device correctly, it need only be aligned in a north-south or other identified direction. Unlike some sundial devices, where a particular inclination or three-dimensional alignment is also required, this device allows use with a much more rudimentary understanding and capability. For instance, by utilizing a separate, integral non-axial device alignment element, the embodiment shown in FIGS. 1 and 2 can be used quite easily. For some embodiments, all that may be necessary is that the north-south block (1) be aligned with a celestial pole. This celestial pole currently is that the north star however it should be understand that this has moved over millennia through gyroscopic precession of the earth's axis. In aligning with a celestial pole, it can be seen that because the integral device presents a raised north-south alignment plane (11), alignment can be fairly easily accomplished such as by optical sighting at night. This raised north-south alignment plane (11) can configured adjacent to a south shadow surface (13) on a south end of the raised north-south alignment plane (11). By aligning the raised north-south alignment plane (11) with a celestial pole, the device can have alignment block end edges that are properly configured such as by being aligned north-south. The entire alignment block can have an alignment block north end edge (7) and an alignment block south end edge (16) which can be sighted to the celestial pole, such as currently at the north star. Such a simple alignment can permit the alignment block sunset corner point (17) to be appropriately configured in relationship to the equinox line (3) as explained later in reference to one embodiment of the invention.

An important concept for some embodiments is the fact that the horological devices can be presented as one single integral device. As an integral device, it can not only be used for many years and be relatively robust, but a simpler capability to both use and manufacture can be manifested. Interestingly, by presenting a single stone horological element, such embodiments reveal how an understanding of the nature of the device might have existed for, and perhaps even been maintained as a secret capability by, persons who might have established themselves as revered or even shamans within prehistoric communities. As shown in FIG. 1, embodiments can present a single stone integrated element where the various surfaces of the stone can serve to present the horological element. As shown, the various components can be integrated to each other so that one almost indestructible device can be presented. For instance, as shown in FIGS. 1 and 2, the north-south block (1) can be integral to the stone base (2). Further, the equinox line (3) may be formed from the stone base (2) with the aligner block adjacent surfaces as shown. This can present a very robust device that could withstand millennia and remain usable.

As mentioned, one of the goals of the present invention is to provide a device which can be relatively easy to use. In general, a relatively small stone block can be presented which can be picked up and moved and positioned. As shown by utilizing a north-south block (1), the user can move the horological element so that it aligns with a celestial pole. By positioning a stone base (2) through its being integral to and attached to the north-south alignment block (1), the act of orienting an equinox line (3) can be easily accomplished. This can serve to permit the orienting of at least one integral solstice indicator. Thus, by having the stone base (2) integrally responsive to the north-south block (1), the integral solstice indicator can be properly aligned.

As mentioned briefly above, the various devices orientation can cause shadow indications for the occurrences of both winter and summer solstices. Embodiments can establish an equinox oriented shade indicator, such as a substantially straight edge as indicated in the equinox line (3) to serve as a shadow indicia or shadow indicator. One aspect that can be understood from FIG. 1 is that embodiments may include a sheer equinox indicator. This sheer equinox indicator can be something as simple as the equinox line (3) having sheer surfaces on one or both sides. These sheer surfaces can serve to create relatively strong shadow occurrences so that easier indications can be understood or observed by a user. As mentioned below, the sheer equinox indicator can also have additional purposes such as indicating one or more solar altitudes.

By having the device alignment element connected to the equinox line (3), movement of one can be responsive to movement of the other to facilitate use. Further, each component can be optically responsive whether by having a surface upon which a shadow is projected or by causing a shadow itself.

As can be appreciated from the integral rock device, embodiments of the invention may present at least one integral solstice indicator. Furthermore, it should be understood that the solstice indicator may only transiently create and transiently identify a particular solstice event. This can be understood by the fact that only at sunrise does the sun create the appropriate shadow indications depicted on this embodiment in FIG. 1. This transient indication can even serve to propagate a shaman-like mysticism of the device or more likely its user in environments such as existing for prehistoric man. For instance, if it is not understood that only at sunrise does the device properly provide the desired indication, it may be very difficult to understand how device acts or even what the device does. It could easily be mistaken, or an observer could easily be lead to believe that the device is some sort of cutting or splitting rock. All this might occur not only while the device actually serves a far more important purpose, namely, that of indicating the solstice events, it could even occur while the device is being used and observed by the knowledgeable user. Even the action of providing a shadow indication could have been difficult for the uninitiated to understand. By providing a shadow based solstice identifier, it might be further maintained as almost a type of trade secret to the mystical person who both maintained and utilized it in societies which less understanding that existing in modern well-educated society.

In operation the device can provide a sun shadow indicia and at least one shadow surface indicator. This shadow surface indicator could emanate from the equinox oriented shade indicator by creating a shadow edge line (15) as explained in more detail later. The shadow edge line (15) could emanate off of an equinox line (3) from the equinox line end (8) to a solstice sunrise corner point. By the fact that the equinox line (3) extends from the equinox line terminus (6), the device can create a shadow on both a shadow surface and on the raised north-south alignment plane (11) to provide an indication on or near the aligner block adjacent surface.

As can be understood from FIG. 1, embodiments can present multiple shadow surface indicators usable at different times of day or different times of year. For example, as shown in FIG. 1, embodiments may include a first shadow surface indicator and a second shadow surface indicator. The first shadow surface indicator may be a north shadow surface (14). Similarly, the second shadow surface indicator may be a south shadow surface (13). As mentioned earlier, the device may be operable transiently and may provide an indication only at certain times of day. Again, as explained later with respect to the use of the devices, these times of day could be either a sunrise time of day or a sunset time of day. As such, devices could present both a sunrise determinant indicator and a sunset determinant indicator. Furthermore, the sunrise determinant indicator could be a sunrise determinant equinox indicator in that it could provide an indication of the equinox as well as indications of the solstices.

Figure 3:
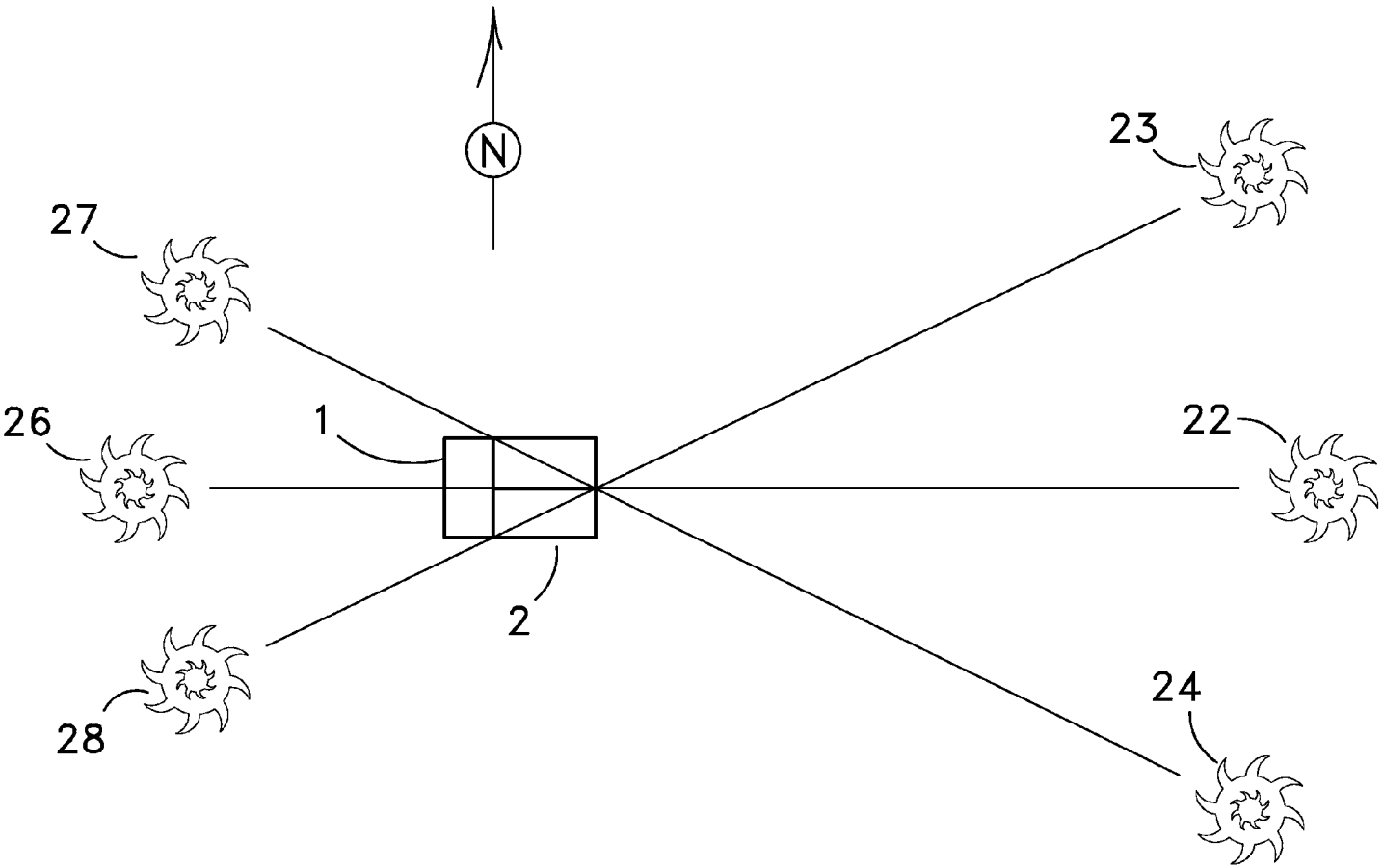
FIG. 3 shows an overall sunrise position diagram from above as it might present itself to a device according to FIG. 1.
Figure 4:
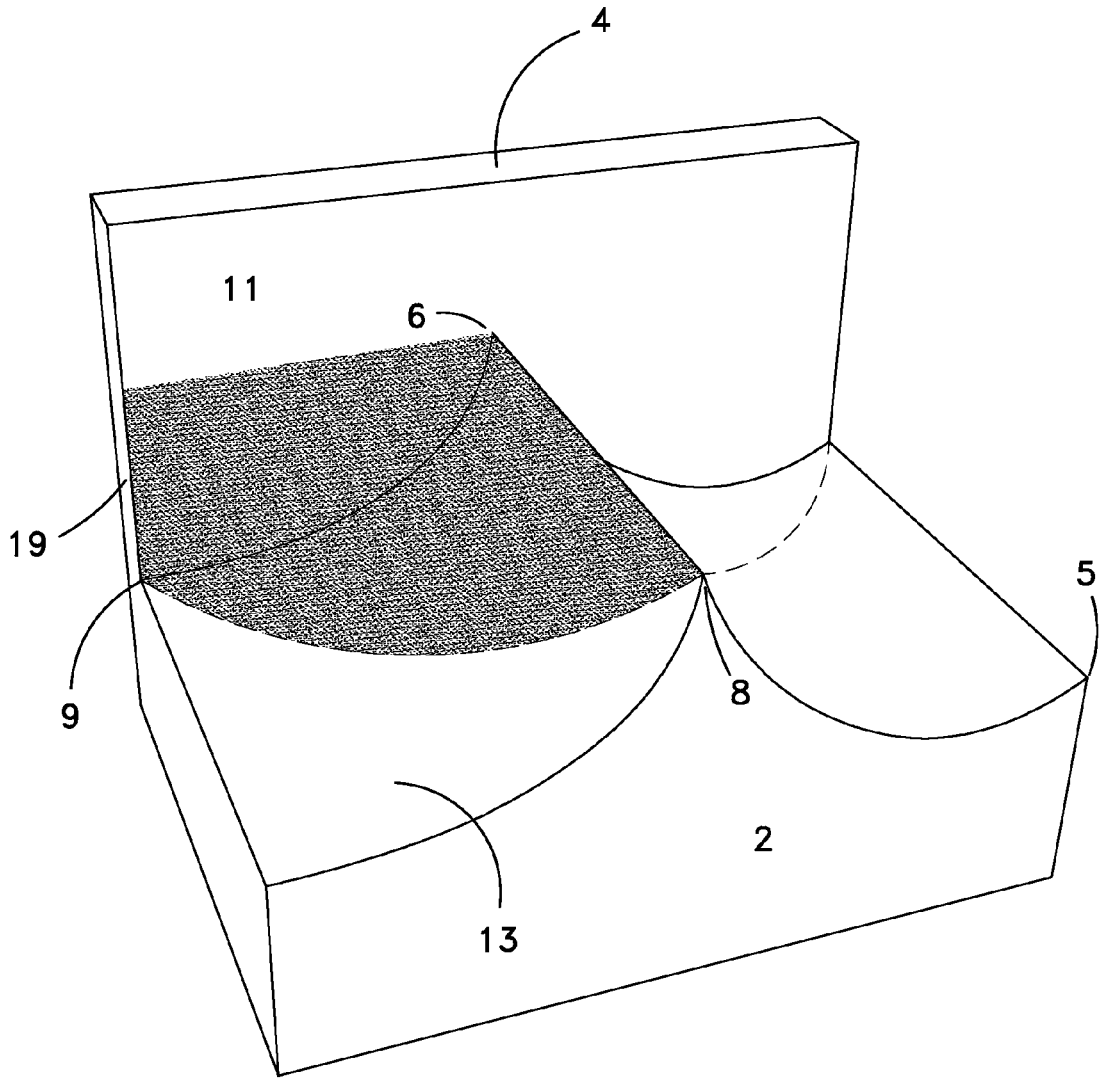
FIG. 4 shows a summer solstice sunrise shadow indication on a basic device of FIG. 1.
Figure 5:
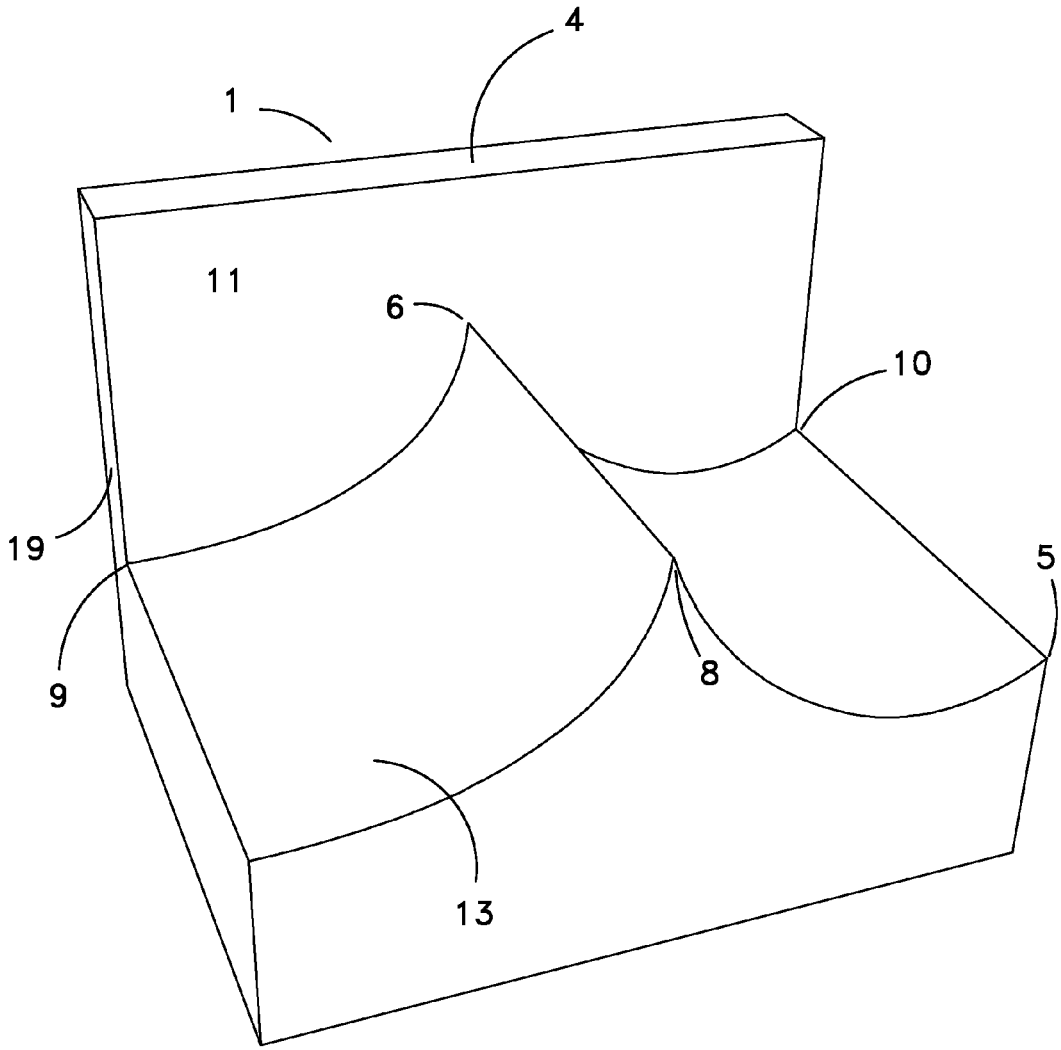
FIG. 5 shows an equinox sunrise shadow indication with no shadow on a basic device of FIG. 1.

Turning now to use of the devices, the actual transient shadow creation can be understood by understanding FIGS. 3-6. FIG. 3 shows sunrise locations as viewed from the top of the device. As shown in FIG. 3, the sunrise occurs at precisely different apparent horizon locations throughout the year. As shown in FIG. 5, at the equinox, when day lengths and night lengths are equal, the sun rises directly east. This equinox sunrise location (22) would create virtually no shadows on the device at the moment of sunrise because the sun's rays would pass right down the equinox line. FIG. 5 depicts no shadow at this point in time, sunrise. This effect, namely, no shadow creation at sunrise on the equinox, is an effect of the sunrise being aligned with the equinox line (3). The precipice from the equinox line (3) casts no shadow on either of the adjacent sloped shadow surfaces because the sun's rays pass along these surfaces, not overtop of them.

Of course, summer days are longer than the winter days. This is due to the Earth's axis being inclined with respect to the ecliptic. This is well understood by any educated modern man. As shown in FIG. 3, and as some observers in the northern hemisphere may already understand, the sunrise is north of due east in the summer and south of due east in the winter. On the summer solstice it rises farthest to the north; on the winter solstice it rises farthest to the south.

The summer solstice sunrise location is depicted in FIG. 3 with the sun shown as positioned at the summer solstice sunrise location (23) at a location that is north of the equinox sunrise point. From this location, at the moment of sunrise the sun's rays project over the equinox line and cast a shadow on the south shadow surface (13). In fact, as can be understood from the geometries depicted in FIG. 4, the sun's rays are in line with the equinox line end (8) and the summer solstice sunrise corner point (9). As may be understood from FIG. 4, a shadow is created by the precipice position of the equinox line (3). This shadow passes along the south shadow surface (13) from the equinox line end (8) directly to the summer solstice sunrise corner point (9). as shown in FIG. 4 this sunrise position creates the shadow edge line (15) depicted along the south shadow surface (13).

Of course, in the days between equinox (when no shadow is created) and the summer solstice (when the shadow shown in FIG. 4 is created) the end of shadow on each successive sunrise day works its way along the raised north-south alignment plane (11) toward the summer solstice sunrise corner point (9). The shadow edge line (15) moves closer and closer to a summer solstice sunrise corner point (9). On the day of the summer solstice, when the sun is positioned at the summer solstice sunrise location (23), the shadow edge line (15) depicted in FIG. 4 passes directly to the summer solstice sunrise corner point (9). This occurrence occurs only at the moment of sunrise. After the summer solstice, the shadow edge line (15) works its way back away from the summer solstice sunrise corner point (9) moving toward an equinox, no shadow, configuration. But on the day when, at sunrise, a shadow edge line (15) passes directly from the equinox line end (8) to a summer solstice sunrise corner point (9), the summer solstice can be positively identified.

Figure 6:
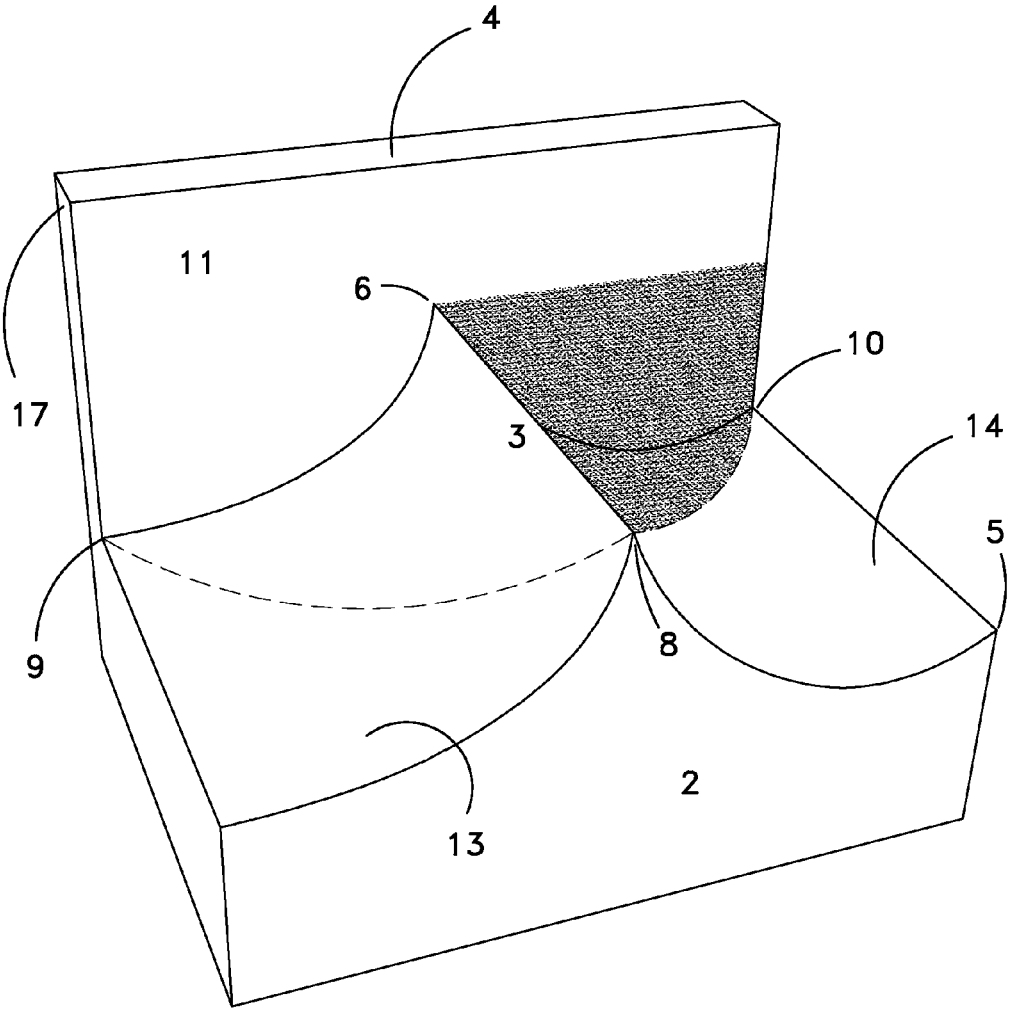
FIG. 6 shows a winter solstice sunrise shadow indication on a basic device of FIG. 1.

Referring to FIG. 3 again, it can be understood how the winter solstice can be similarly identified. As shown in FIG. 3, the winter solstice sunrise location (24) is south of the equinox sunrise location (22). As shown in FIG. 6, on this particular day, namely, the winter solstice, the sun's rays cast a shadow that passes from the equinox line end (8) directly to the winter solstice sunrise corner point (10). In this fashion, when the shadow goes directly to the winter solstice sunrise corner point (10), the user can affirmatively identify the winter solstice. As shown on the horological device depicted in FIG. 6, that shadow edge line (15) passes from the equinox line end (8) directly to the winter solstice sunrise corner point (10). Identification of the winter solstice could be significant those equivalent to prehistoric societies because reaching this day can inform a user that the days will now become longer and eventually the temperatures will become warmer. Of course, this cycle repeats year after year as the sun passes from the winter solstice sunrise location (24) back to the equinox sunrise location (22) and onward to the summer solstice sunrise location (23) and then back to the equinox sunrise location (22) and so on. As may be appreciated, by configuring an angled block indicator at the north (or south) end of the north-south block (1) in line with the shadow edge line (15) such as indicated in weathered form in FIG. 12, binary shadow creation (as discussed later) can be achieved so as to cause shadowing at sunrise of this angled block indicator only on the winter (or summer) solstice. On any other day, at sunrise, the angled block indicator will be illuminated but on this one day it will be in a shadow and thus serve as a very positive indication of the solstice occurrence.

As may be appreciated from the foregoing description, the shadow indication is a transient indication. That is, it only exists at the sunrise time of day. As the sun rises above the horizon, it casts a shadow that is also downward and the precise shadow creation by the equinox line (3) becomes skewed. By providing an accurate indication only at sunrise, embodiments of the invention can be configured to include a sunrise determinant indicator that only provides an affirmative or accurate indication at the moment of sunrise.

Similarly, as shown in the basic device depicted in FIGS. 3 through 6, an equinox indication can also be provided. Again, this can be a sunrise determinant equinox indicator, and the device can create sunrise shadow indicia that provide the desired information. As may be appreciated, the equinox indication may or may not be included. For example, devices may be designed such that only the two solstices or even one or the other solstice is indicated. This can occur by simply aligning a shadow creation element such as the vertical edge along an appropriate line. Symmetrical designs as shown may or may not be included as well. All that is necessary is that the end indication perhaps along a surface such as the raised north-south alignment plane (11) is available to a user. As may also be appreciated due to either lack of understanding, more sophisticated understanding and design, or even manufacturing inaccuracies, off-axis and also non-symmetrical designs are possible. Through off-axis manufacture or individual creation of an item such as the equinox line (3), the device may be calibrated by appropriately adjusting the lengths or other markings to accurately locate a desired summer solstice sunrise corner point (9) or winter solstice sunrise corner point (10). This could be of particular value in instances where the device is fashioned from a relatively brittle or shearing substance such a stone with rudimentary tools where exact manufacture could be difficult to get exactly precise.

As may also be understood, the moment of sunset also presents an opportunity to provide accurate indications and can be used on certain embodiments of the discovery. Of course, the sun sets in the west. Referring again to FIG. 3, it can be understood that the summer solstice sunset location (26) is to the north of the equinox sunset location (27). Similarly, the winter solstice sunset location (28) is to the south of the equinox sunset location (27). Since each of these present a known location, they can also be used to indicate calendar time.

FIGS. 1 and 2 depict an embodiment that is also capable of depicting a sunset solstice date. As shown in these figures, embodiments of the horological device may include an alignment block sunset corner point (17) and an alignment block south end edge (19). As shown, this alignment block south end edge (19) may be configured to present an alignment block south vertical edge (18). At the opposite end of the north-south block (1) embodiments may also include an alignment block north end edge (20). This alignment block north end edge (20) may also be vertical as depicted. For such a design, the sunset indications can also be understood from the shadow edge lines (15) depicted in FIGS. 4 and 6 and an understanding of the sunset locations shown in FIG. 3.

Interestingly, while the south shadow surface (13) provided the summer solstice indication at sunrise, the north shadow surface (14) provides the summer solstice indication at sunset. Referring first to the summer solstice event, while a sunrise indication is depicted in FIG. 4, a summer solstice sunset indication is depicted in FIG. 6. Referring to FIG. 6, it can be seen that the shadow edge line (15) depicted in FIG. 6 can be a shadow edge line (15) created at either a sunset for the summer solstice. Just as the sunrise event created a shadow edge line, the sunset event also creates a shadow edge line. As may be understood from FIG. 6, at sunset on the summer solstice, a shadow is created from the alignment block north end edge (20). This shadow passes along the north shadow surface (14) from the alignment block north end edge (20) directly to the equinox line end (8). As shown in FIG. 6 this sunset position creates the shadow edge line (15) depicted along the north shadow surface (14) that is the same line as for a sunrise winter solstice event. When such a shadow edge line (15) occurs at a sunset time of day, the sun's rays pass from the along the alignment block north end edge (20) to the equinox line end (8). In this fashion, the device could actually provide two indications of the summer solstice, namely one at sunrise and one at sunset.

A similar design can provide a sunrise and sunset indication for the winter solstice as well. As FIGS. 3 and 4 help explain, on the winter solstice, the sunset indication exists as depicted in FIG. 4. On this day, the sun's rays at sunset pass from the Sun along the alignment block south vertical edge (18) to the equinox line end (8). In this manner device can be designed to provide a sunset determinant indicator, and to provide a separate second transiently identification technique. This separate second transiently identification event can occur at a different time of day, namely, sunset as opposed the sunrise for the first indication. Further, in separately second transiently identifying a solstice, a shadow edge line (15) may emanating off of an alignment block end edge. This alignment block end edge could be an alignment block north end edge (20) or an alignment block south end edge (19). For a sunset indication, the shadow edge line (15) may be active and provide a reliable or accurate indication only at a sunset event. In this instance, the device can transiently identify a first solstice date and transiently sunrise identify a second solstice date. Again, the shadow edge line (15) may be active or at least accurately indicate only at an identified time of day perhaps such as sunrise or sunset.

As can be understood, the device can serve to create a shadow edge line (15) by a common equinox precipice such as the equinox line (3) depicted in FIGS. 1-6. This common equinox precipice can include a raised area as indicated at the equinox line (3). Further, as discussed, the equinox line end (8) may be aligned for a solstice indication so that shadows are correctly created as desired. Again, this may occur substantially only at a sunrise or sunset time of day. Thus the indicator can be active substantially only at a sunrise or sunset event.

An aspect that facilitates use is the fact that the shadow edge line (15) can be incipiently created. The shadow edge line (15) can create a larger area that rapidly moves or removes its area from the device due to how it is created. By being incipiently created, more noticeable changes can occur at the desired time or event. This can be described as binary shadow creation, that is, a shadow that is rapidly transitioning from existing at the proper location or time to not existing at a different location or time. This can be created by components such as a precipice design as shown along the equinox line (3) in FIG. 2. Thus the equinox line (3), can serve as a binary shadow creator, perhaps by presenting a substantially straight edge and a relatively sharp precipice or edge. This relatively sharp precipice can exist on either or both sides such as for embodiments that indicate both summer and winter solstice events. By presenting an equinox precipice and utilizing a divergently sloped shadow surface or surfaces as shown, the device can create relatively sharp and fairly dynamic shadow indications. As may be appreciated from the design shown in FIG. 2, embodiments may utilize a dual side equinox precipice that can be used to create the desired shadow indicia.

Of course, an equinox line (3), and even an equinox oriented precipice need not be included. From the perspective of symmetry and easier understanding, the embodiment shown in FIGS. 1 through 6 depicts a relatively symmetric design, where an approximately bisecting indicator is used. This approximately bisecting indicator may be an item such as the equinox line (3), which can establish a shadow surface bisector. This shadow surface bisector can roughly divide the device into a north shadow surface (14) and a south south shadow surface (13). These two may be roughly the same size as shown and may approximately bisect the north-south block (1) and the device may present a single stone integrated bisector design such as shown.

FIG. 2 depicts a side view of a basic embodiment of the horological device. As may be appreciated, a north shadow surface (14) and a south shadow surface (13) need not be oriented symmetrically. In fact, it is possible that the north shadow surface (14) may include a raised lip (5) on a north edge. This can serve as another indication relative to a solstice event, namely it can indicate an altitude of the sun such as a solar altitude.

Figure 7:
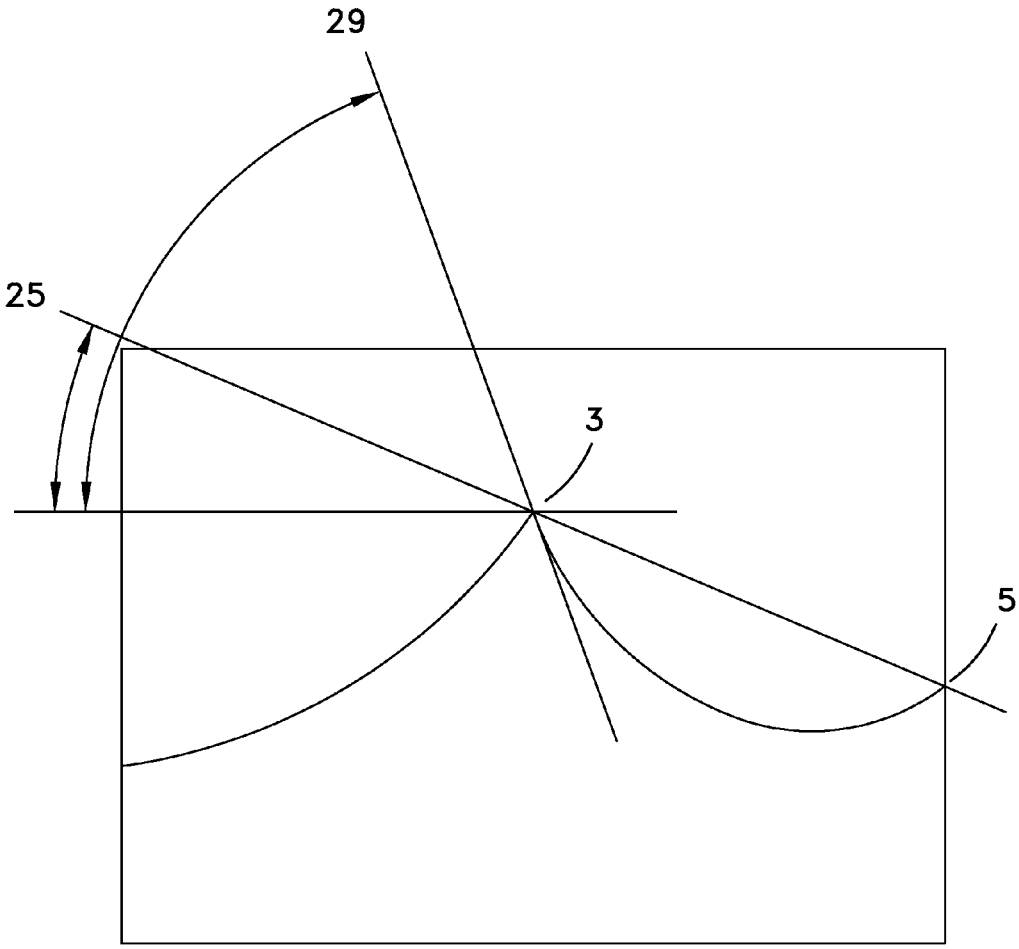
FIG. 7 shows a side view diagram of a maximum solar altitude as indicated on a basic device as shown in FIG. 1.
Figure 8:
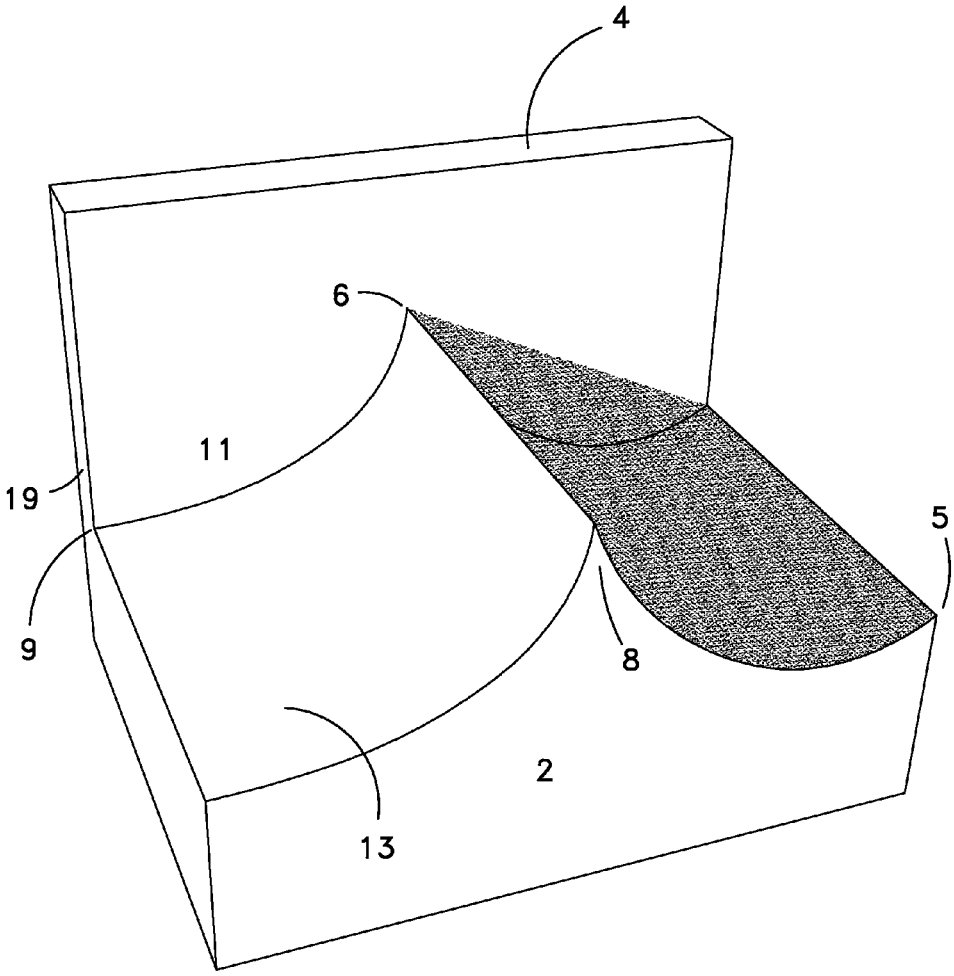
FIG. 8 shows a shadow view of a maximum solar altitude indication on the basic device shown in FIG. 1.

The apparent movement of the sun due to the earth's rotation makes the sun rise in the east, reach a maximum altitude when nearly south, and set in the west. The maximum altitude varies based on the time of year. It is highest on the summer solstice, and this maximum solar altitude is lowest on the winter solstice. Of course, because the winter solstice is both the shortest and day could be nearly the coldest day of the year, it may be helpful to understand when the days become longer and perhaps warmer. It may also be helpful to understand the approximate height of the sun at noon on the winter solstice. As shown in FIG. 7, the horological device can indicate one or more maximum solar altitude(s). As shown, the winter solstice maximum solar altitude (25) can occur at an altitude determined by the latitude of measurement. As depicted in FIGS. 7 and 8, it can be seen that the sun's rays could pass on a line that projects from the equinox line (3) to a raised lip (5). An altitude higher than this would leave the raised lip (5) in the sun, but on the winter solstice, the entire north shadow surface (14) is entirely in shadow as shown in FIG. 8. In this fashion the horological device can present a shadow surface indicating a maximum solar altitude, such as the maximum solar altitude on the winter solstice as shown for the winter solstice maximum solar altitude (25). This can be indicated on the north shadow surface (14) and devices can thus present a north shadow surface indicating a maximum solar altitude. This can occur along the north top edge of the north shadow surface (14). It may also occur by including a raised lip (5) to which a shadow can project off of the equinox line (3). In this fashion a shadow can appear on a north shadow surface (14) opposite the equinox line (3) and thus the device can include a solar altitude indicator. As shown in FIG. 7 a solar altitude indicator can be a maximum winter solstice solar altitude indicator.

Other configurations to indicate additional or other maximum solar altitudes are also possible. Embodiments can additionally or separately indicate a maximum summer solstice solar altitude (29) as shown in FIG. 7. Both winter and summer maximum solar altitudes can be combined on device such as by configuring the precipice off the equinox line (3) on a north shadow surface (14) at an angle. By proper design, no shadow might appear just off the equinox line (3) along the north shadow surface (14) at the precise occurrence of the summer solstice. In this manner the north divergently sloped shadow surface can be utilized and can serve as a north shadow surface maximum solar altitude indicator or even a maximum summer solstice solar altitude indicator or can accomplish the method of indicating a maximum summer solstice solar altitude (29).

An important aspect is that the entire device can be non-axially aligning. By this is meant that the device need not be oriented with the Earth's axis as some sun dials are. This device need only be oriented in a north-south position. Of course, it should be understood that through utilization of the alignment block leveler surface (4), additional alignment activities can also occur. At its most basic level, however, by aligning a planar side of the horological element, such as the raised north-south alignment plane (11), the entire device can be properly positioned. By this type of alignment, the equinox line terminus (6) abutting the bottom of the raised north-south alignment plane (11) can be positioned so that the equinox line (3) emanating from the raised north-south alignment plane (11) is placed in the proper direction. As may be understood, the alignment action or step may be accomplished by optically planarly aligning the horological element. By planar alignment, only a rough and relatively easy alignment of any line along the plane with the north celestial pole or perhaps now the north star can be easily achieved. As shown in FIG. 1, embodiments may present a horizontal north-south planar aligner that may be aligned independent of the earth's rotational axis at any latitude, and embodiments may present an earth rotational axis latitude independent aligner.

As mentioned earlier, it also possible to provide or accomplish the additional step of leveling an element perhaps by maintaining at least one portion of the device in a level orientation. For instance, the north-south block (1) may have integral to it an alignment block leveler surface (4). This leveler surface may be the top surface of the north-south block (1) as shown or may be at another location. The alignment block or other leveler surface can serve to at least partially orient one or more integral components. This may include partially orienting at least an integral sunset determinant indicator. By leveling some component, such as the north-south block top surface, the device can also be oriented in a separate axis. This can also aid in the maximum solar altitude aspect mentioned above if such is included.

Figure 9:
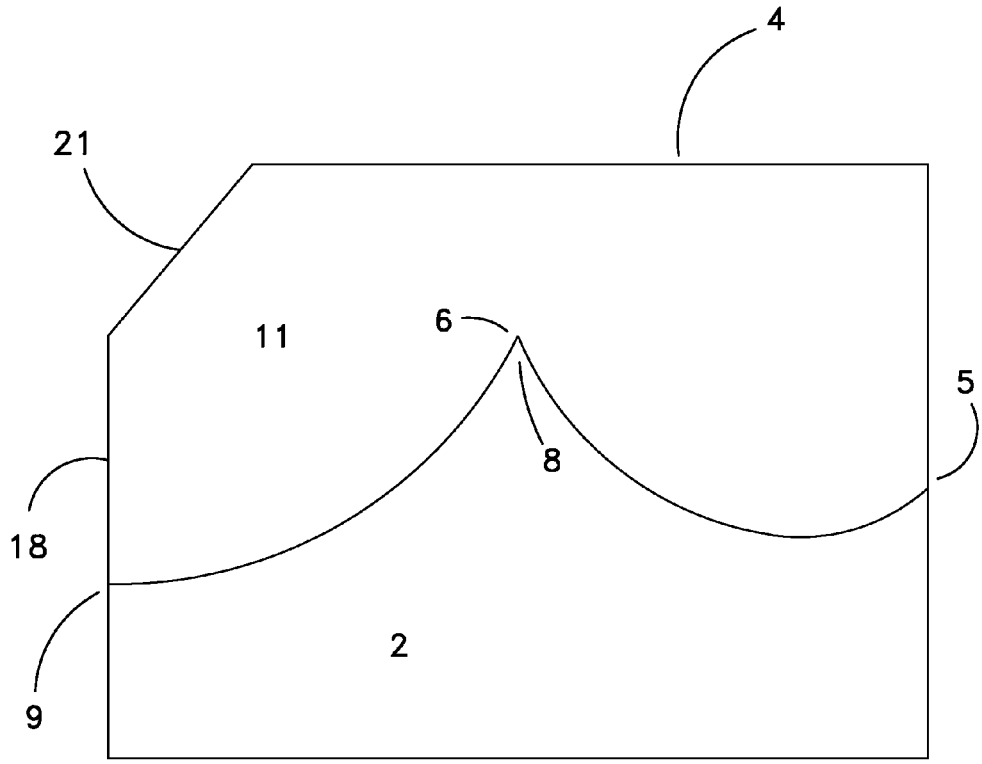
FIG. 9 shows a side view of an angled block embodiment of the invention that includes a winter sunset indicator.
Figure 10:
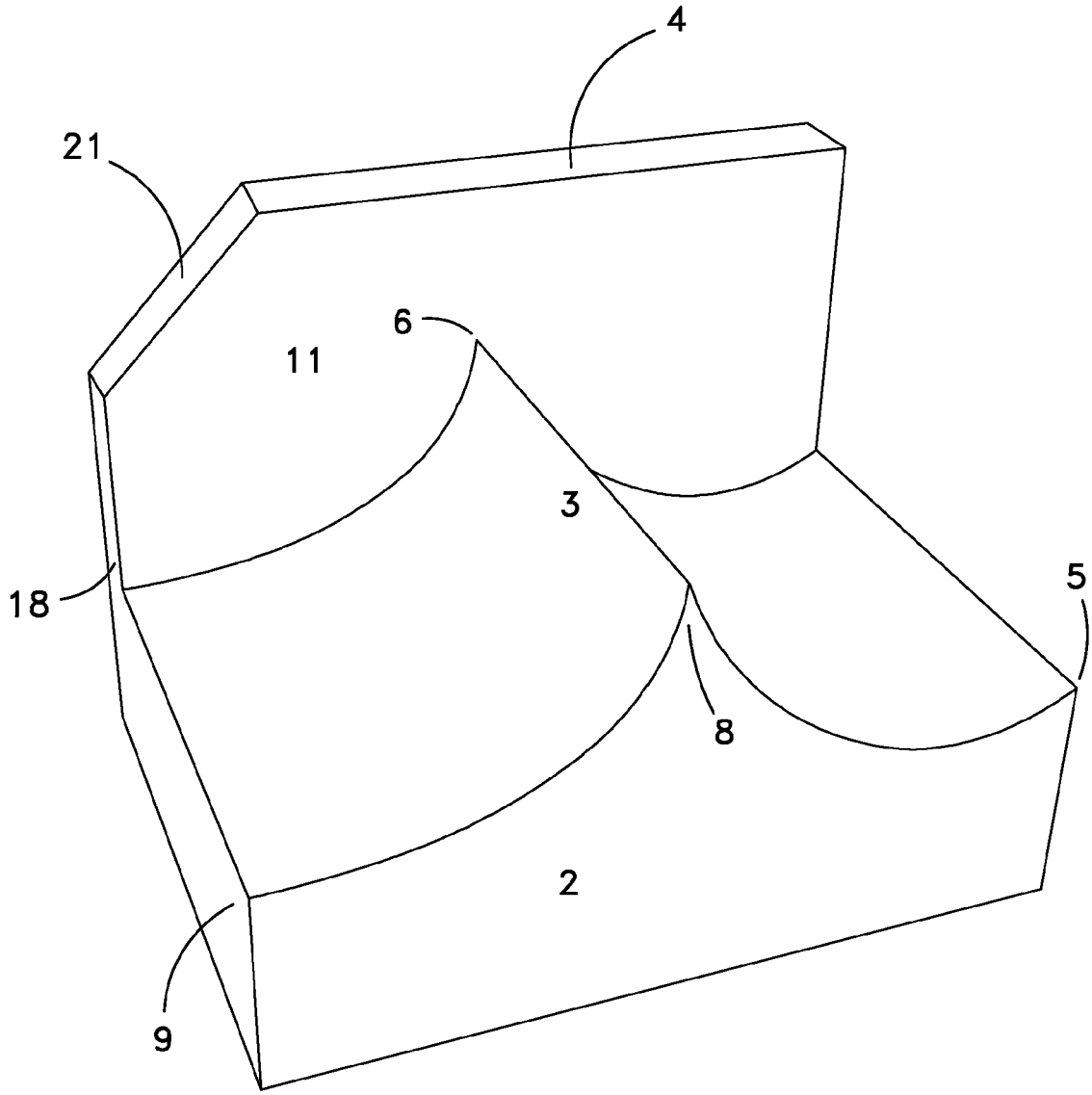
FIG. 10 shows a perspective view of an angled block embodiment shown in FIG. 9.
Figure 13:
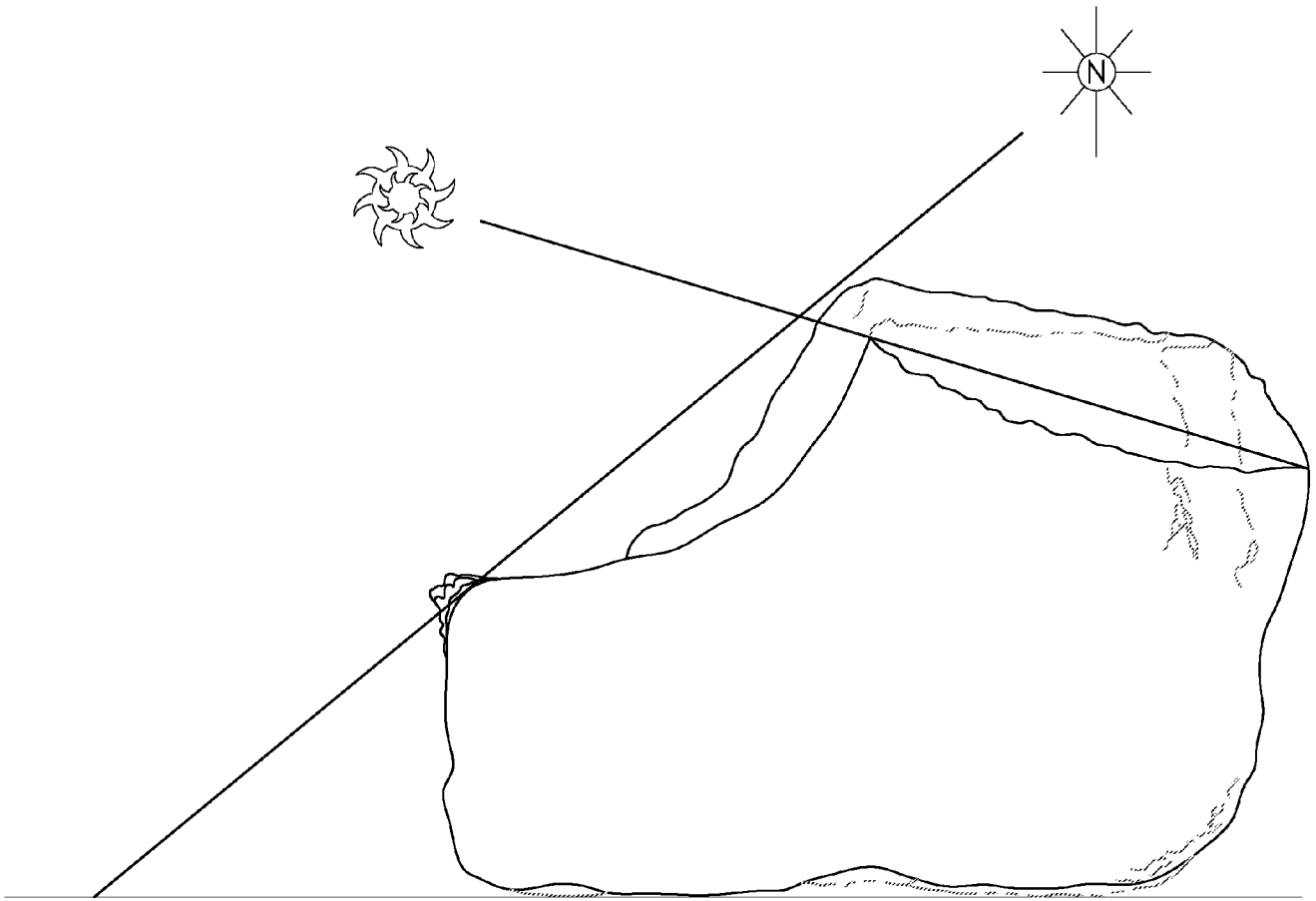
FIG. 13 is a side view of the artifact shown in FIG. 12.

A leveler surface is one way embodiments can be configured to indicate at least one earth latitude factor or include an earth latitude factor indicator. Another way is shown in FIG. 9 where the south edge of the north-south alignment block (1) can be inclined such as to present an alignment block angle edge (21) that can serve as an alignment block indicator. In other embodiments devices may have alignment block south end edge (19) that might present an alignment block south vertical edge (18). The alignment block angle edge (21), however, can serve as either an identifier of an earth latitude or some factor related to it, such as the angle at which an object appears, or perhaps such as the celestial pole. This can serve as an alignment aid in locating the celestial pole to permit north-south alignment of the raised north-south alignment plane (11). The alignment block can serve as or include a star latitude indicator, a celestial pole indicator, or some other component for a latitude factor indication. The alignment block indication can be accomplished in alignment by an alignment block south end edge indication. By using the alignment block angled edge (21) indicator, or at least a beginning and ending point on such a surface, the user can site along the alignment block south end edge to a non-moving star such as the north celestial pole or the north star. Embodiments can accomplish alignment block indicating at least one latitude factor that can enhance use of the device. As shown in FIGS. 9 and 10, the alignment block angle edge (21) can be used even with a sunset solstice capability by configuring the bottom of the alignment block angle edge (21) at the point above a vertical edge segment (18) so both features can be included in one embodiment. FIG. 13 shows as the alignment block angle edge (21) can be designed to project from the bottom of the south shadow surface (13) as well and in this design only a summer solstice sunrise indicator might be included.

Figure 11:
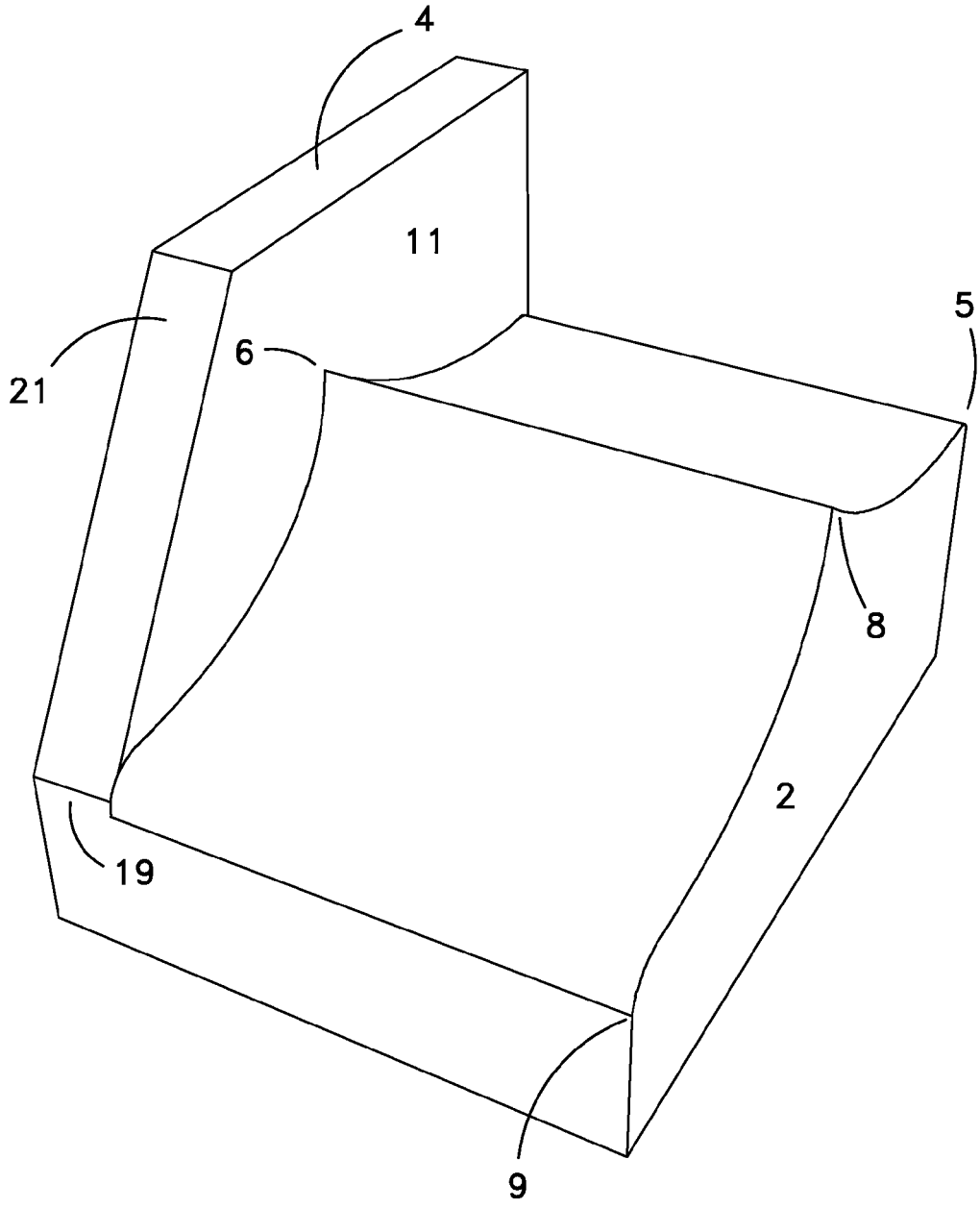
FIG. 11 shows a perspective view of another angled block embodiment.
Figure 12:
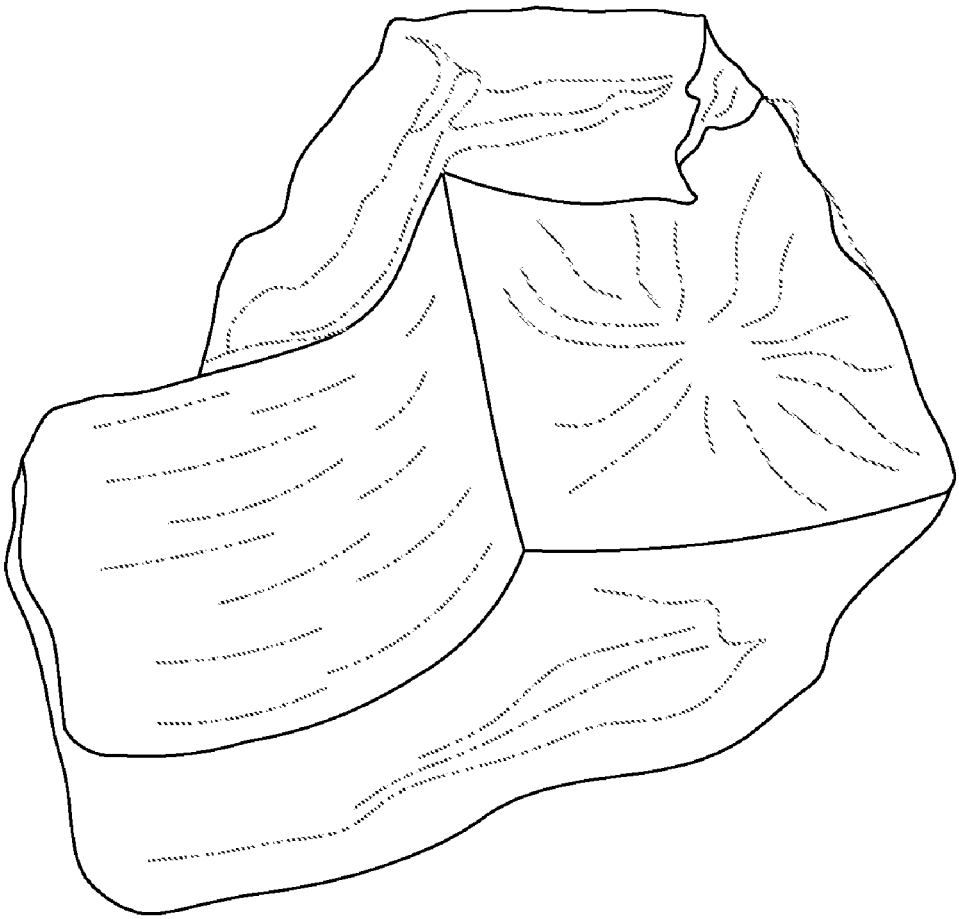
FIG. 12 is a perspective drawing of an artifact that discloses features that could serve in accordance with the present invention.

Finally, the discovery that lead to and to some degree includes the invention is depicted in FIGS. 11 and 12. As can be seen, this device is an integral stone device that has been weathered over millennia. It shows the remnants of north shadow surface (14) and the south shadow surface (13), the equinox line (3), a north-south block (1), and perhaps even an alignment block angle edge (21) that might have existed millennia ago. It also shows an angled block indicator at the north end of the north-south block (1) to cause shadowing at sunrise of this angled block indicator only on the winter solstice.

As can be easily understood from the foregoing, the basic concepts of the present invention may be embodied in a variety of ways. It involves both calendar indication techniques as well as devices to accomplish the appropriate date indicating. In this application, the indication techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this provisional application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of an "indicator" should be understood to encompass disclosure of the act of "indicating"—whether explicitly discussed or not—and, conversely, were there effectively disclosure of the act of "indicating", such a disclosure should be understood to encompass disclosure of an "indicator" and even a "means for indicating." Such changes and alternative terms are to be understood to be explicitly included in the description.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the horological devices as herein disclosed and described, ii) the related methods disclosed and described, iii)

similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A celestial calendar device comprising:

a stone base;

a north-south block integral to said stone base;

a raised north-south alignment plane formed as an edge of said north-south block;

an equinox line formed from said stone base and emanating from a bottom of said raised north-south alignment plane;

an equinox line terminus abutting said bottom of said raised north-south alignment plane;

an equinox line end opposite said equinox line terminus on said equinox line aligned for a solstice indication;

a north shadow surface formed from said stone base adjacent a north side of said equinox line and abutting said bottom of said raised north-south alignment plane configured for a first type of solstice indication;

a south shadow surface formed from said stone base adjacent a south side of said equinox line and abutting said bottom of said raised north-south alignment plane configured for said first type of solstice indication;

a summer solstice sunrise corner point adjacent said south shadow surface and a south end of said raised north-south alignment plane; and a winter solstice sunrise corner point adjacent said south shadow surface and a south end of said raised north-south alignment plane.

2. A celestial calendar device as described in claim 1 wherein each component comprises a single stone integrated element.

3. A celestial calendar device as described in claim 2 and further comprising:

an alignment block north end edge configured for a second type of solstice indication;

an alignment block south end edge configured for said second type of solstice indication.

4. A celestial calendar device as described in claim 3 wherein said north-south block comprises a parallel side block.

5. A celestial calendar device as described in claim 3 and further comprising a dual side equinox precipice.

6. A celestial calendar device as described in claim 5 wherein said equinox line comprises a north-south block bisector.

7. A celestial calendar device as described in claim 6 wherein said equinox line comprises a divergently sloped shadow surface.

8. A celestial calendar device as described in claim 7 wherein said north-south block comprises a north-south block top leveler surface.

9. A celestial calendar device as described in claim 8 and further comprising a raised lip on said north shadow surface configured to indicate at least one maximum solar altitude.

10. A celestial calendar device as described in claim 9 and further comprising an alignment block angled edge on said north-south block configured to indicate at least one earth latitude factor.

11. A celestial calendar device as described in claim 1 wherein said north-south block comprises a north-south block top leveler surface.

12. A method of indicating calendar time from a celestial event comprising the steps of:

providing a stone base with a north-south block integral to said stone base having a raised north-south alignment plane formed as an edge of said north-south block and having at least one corner point;

establishing an equinox line formed from said stone base emanating from a bottom of said raised north-south alignment plane, wherein the equinox line has a terminus abutting a bottom of said raised north-south alignment plane and an end opposite said equinox terminus aligned for a solstice indication, and wherein a north shadow surface formed from said stone base adjacent a north side of said equinox line and abutting said bottom of said raised north-south alignment plane is configured for a first type of solstice indication, and a south shadow surface formed from said stone base adjacent a south side of said equinox line and butting said bottom of said raised north-south alignment plate is configured for said first type of solstice indication;

casting a shadow indicia from said equinox line formed from said stone base;

terminating said shadow at said corner point;

identifying a solstice date from said shadow indicia on said horological element at an identified time of day.

13. A method of indicating calendar time from a celestial event as described in claim 12 wherein each component comprises a single stone integrated element.

14. A method of indicating calendar time from a celestial event as described in claim 13 wherein said step of establishing an equinox line formed from said stone base emanating from a bottom of said raised north-south alignment plane comprises the step of establishing a dual side equinox precipice formed from said stone base emanating from a bottom of said raised north-south alignment plane.

15. A method of indicating calendar time from a celestial event as described in claim 14 wherein said step of establishing a dual side equinox precipice formed from said stone base emanating from a bottom of said raised north-south alignment plane comprises the step of establishing a divergently sloped shadow surface.

16. A method of indicating calendar time from a celestial event as described in claim 12 wherein said identified time of day comprises a sunrise time of day.

17. A method of indicating calendar time from a celestial event as described in claim 12 wherein said corner point comprises a summer solstice sunrise corner point at a south end of said raised north-south alignment plane, and wherein said step of terminating said shadow at said corner point comprises the step of terminating said shadow at said summer solstice sunrise corner point at said south end of said raised north-south alignment plane.

18. A method of indicating calendar time from a celestial event as described in claim 12 wherein said corner point comprises a winter solstice sunrise corner point at a north end of said raised north-south alignment plane, and wherein said step of terminating said shadow at said corner point comprises the step of terminating said shadow at said winter solstice sunrise corner point at said north end of said raised north-south alignment plane.

19. A method of indicating calendar time from a celestial event as described in claim 12 wherein said step of establishing an equinox line formed from said stone base emanating from a bottom of said raised north-south alignment plane comprises the step of establishing a single stone integrated bisector.

20. A method of indicating calendar time from a celestial event as described in claim 12 and further comprising the step of planarly aligning said north-south block with a celestial object.

* * * * *